United States Patent [19]

Buchheim

[11] 4,192,139

[45] Mar. 11, 1980

[54] COMBUSTION CHAMBER FOR GAS TURBINES

[75] Inventor: Rolf Buchheim, Brunswick, Fed. Rep. of Germany

[73] Assignee: Volkswagenwerk Aktiengesellschaft, Wolfsburg, Fed. Rep. of Germany

[21] Appl. No.: 812,386

[22] Filed: Jul. 1, 1977

[30] Foreign Application Priority Data

Jul. 2, 1976 [DE] Fed. Rep. of Germany ..... 2629761

[51] Int. Cl.[2] ..... F02C 7/22

[52] U.S. Cl. ..... 60/739; 60/39.82 P; 60/746; 60/750

[58] Field of Search ..... 60/39.65, 39.71, 39.82 P

[56] References Cited

U.S. PATENT DOCUMENTS

| | | | |
|---|---|---|---|
| 2,864,234 | 12/1958 | Seglem et al. | 60/39.82 P |
| 3,691,766 | 9/1972 | Champion | 60/39.65 |
| 3,859,786 | 1/1975 | Azelborn et al. | 60/39.65 |
| 3,859,787 | 1/1975 | Anderson et al. | 60/39.65 |
| 3,872,664 | 3/1975 | Lohmann et al. | 60/39.65 |
| 3,934,409 | 1/1976 | Quillevere et al. | 60/39.65 |
| 3,954,389 | 5/1976 | Szetela | 60/39.82 P |
| 3,982,392 | 9/1976 | Crow | 60/39.65 |
| 4,012,904 | 3/1977 | Nogle | 60/39.65 |
| 4,073,134 | 2/1978 | Koch | 60/39.65 |

*Primary Examiner*—Robert E. Garrett

*Attorney, Agent, or Firm*—Brumbaugh, Graves, Donohue & Raymond

[57] ABSTRACT

A combustion chamber for a gas turbine is provided with a prechamber connected at the input end of the flame tube. The dimensions of the flame tube and prechamber, and the location of the air inlet openings are selected so that the flame in the flame tube flashes back and burns as a stable rich flame in the prechamber when the turbine is in a high-load condition. The result is a variation in the combustion properties of the chamber which reduces pollutant emission levels over a wide range of engine load conditions.

8 Claims, 4 Drawing Figures

LEAN
RICH

IGNITION LIMIT WITH AUXILIARY FLAME
IGNITION LIMIT WITHOUT AUXILIARY FLAME
NOx FOR PREMIXED HOMOGENEOUS FLAME
STOICHIOMETRIC MIXTURE
NOx FOR DIFFUSION TYPE FLAME
EMISSIONS
I
II
III
CO
FUEL-AIR-RATIO

FLAME VELOCITY
STOICHIOMETRIC MIXTURE
FUEL-AIR-RATIO

COMBUSTION CHAMBER FOR GAS TURBINES

BACKGROUND OF THE INVENTION

This invention relates to gas turbine engines and particularly to a combustion chamber for gas turbine engines for use in a motor vehicle.

In an automotive gas turbine, it is relatively simple to design the combustion chamber so that emissions of carbon monoxide and hydrocarbons are minimized. Considerable difficulties are encountered in reducing nitrous oxide emissions because of the variation in fuel-air ratio of the combustion gases under various turbine load conditions. In particular, when the combustion gas is a homogeneous mixture of fuel and air, low nitrous oxide emissions are experienced for relatively lean fuel mixtures, but substantially higher nitrous oxide emissions occur for richer mixtures, which are required at higher engine load conditions.

Prior German Patent Application No. 2,460,709 discloses a combustion chamber for a gas turbine wherein the flame tube is connected to the outlet of a prechamber containing an air inlet and fuel injector at the end of the prechamber away from the flame tube. The prechamber is provided with peripheral air intake openings in the vicinity of the flame tube which are mechanically adjustable in order to change the fuel-air mixture under various engine operating conditions. Because of their location adjacent the prechamber and flame tube, the adjustable air intake openings are exposed to the high temperatures of the flame tube and consequently subject to a breakdown or malfunctioning.

It is therefore an object of the present invention to provide a new and improved combustion chamber for a gas turbine, having reduced emissions of nitrous oxides.

It is a further object to provide such a combustion chamber wherein the combustion process is varied without mechanical control to provide low emission combustion under a variety of operating conditions.

SUMMARY OF THE INVENTION

In accordance with the invention, there is provided a combustion chamber for a gas turbine which includes a flame tube connected with an exhaust passage at its outlet end. The inlet end of the flame tube is connected to a prechamber having a fuel delivery device and a ring-shaped air inlet opening at the end away from the flame tube. Uncontrolled air inlet openings are provided in the prechamber between the fuel delivery device and the flame tube. The cross-sectional dimensions of the prechamber are a selected amount smaller than those of the flame tube to cause a stable flame in the flame tube at fuel delivery rates below a selected value and to cause flame flashback and a stable rich flame in the prechamber at higher fuel delivery rates associated with higher turbine loads.

In a preferred embodiment, the ring-shaped inlet of the antechamber is nozzle-shaped and is provided with a fuel injection nozzle and tubes connected to the flame tube for the return of combustion gases. The prechamber is preferably tapered and the uncontrolled air inlets are located in the tapered portion. The flame tube may divided into first and second flame chambers separated by a narrow cross-section passage and provided with air inlet openings on the downstream side of the passage. An auxiliary combustion chamber may be provided to produce an auxiliary flame which may alternately be directed into one of the flame chambers by the use of control air lines. The auxiliary flame is directed into the first flame chamber to cause combustion in that chamber under minimum engine load conditions. The auxiliary flame is directed into the second flame chamber to provide burning of a relatively leaner mixture, provided with additional air from the intakes in the second chamber, at higher engine loads At still higher engine load conditions, the richer fuel-air mixture has an increased flame propogation velocity which exceeds the combustion gas velocity and causes the flame to flash back into the prechamber and burn as a rich flame, which has low emissions under higher load conditions.

For a better understanding of the present invention, together with other and further objects, reference is made to the following description taken in conjunction with the accompanying drawings and its scope will be pointed out in the appended claims.

DESCRIPTION OF THE INVENTION

Figure 1:
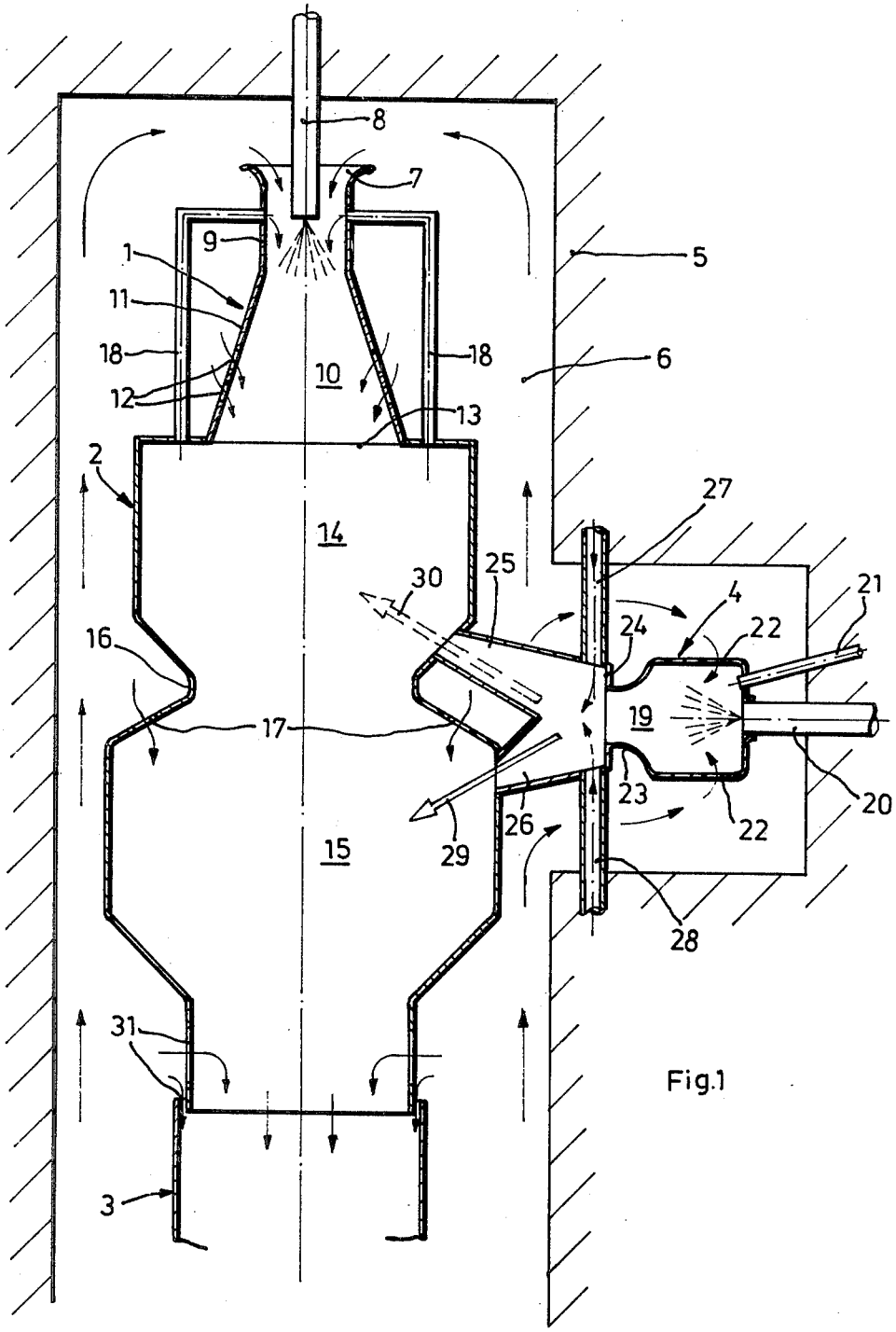
FIG. 1 is a cross-sectional view of a combustion chamber for a gas turbine in accordance with the invention.

The cross-sectional view of FIG. 1 illustrates four principle parts of the combustion chamber consisting of a prechamber 1 at the intake end, a flame tube 2 connected to the prechamber outlet, an exhaust passage 3 at the outlet of flame tube 2, and an auxiliary combustion chamber 4 for providing an auxiliary flame. The entire combustion chamber is maintained within a outer case 5 and the space 6 between the combustion chamber and outer casing is used to conduct air from the turbine compressor to the intake openings of the combustion chamber. The prechamber 1 is provided with a ring-shaped air intake 7 which surrounds fuel injection nozzle 8. The intake region 9 is nozzle-shaped, while the remaining region 10 of the antechamber is a tapered diffusing area and is provided with uncontrolled air inlet openings 12 in its outer jacket 11. The tapered region provides for evaporation of fuel mixture of combustion gases, and pressure recovery in the combustion chamber. Further, the air inlets prevents recirculation turbulence in the diffuser and avoid premature ignition. Abrupt enlargement of the cross-sectional dimensions of the combustion chamber takes place at the junction 13 between flame tube 2 and prechamber 1. The abrupt enlargement causes gas vortex turbulence in flame chamber 14 which promotes further mixture and flame stabilization even for a very lean mixture. Tubes 18 are provided to connect flame tube 2 to the intake region 9 of the prechamber into which fuel is injected by nozzle 8. Tubes 18 enable the return of hot combustion gases from flame tube 2 to the nozzle section 9 in order to promote rapid evaporation of the injected fuel even prior to the attainment of normal operating temperature of the regenerators of the gas turbine installation. Further, the mixture with hot combustion gases enhances fuel pyrolysis prior to combustion and permits leaner combustion.

Flame tube 2 is divided into a first flame chamber 14 and a second flame chamber 15 by a narrow passage 16. The downstream side of passage 16 is provided with air inlet openings 17 which provide additional air so that a leaner fuel-air mixture exists in flame chamber 15 than in flame chamber 14 for the same quantity of injected fuel. Additional air inlet openings 31 are provided at the downstream end of flame chamber 15 to provide cooling of the exhaust gases to the allowed turbine inlet temperature. Auxiliary combustion chamber 4 is provided with fuel injection nozzle 20 and igniter 21 which project into flame space 19. Air inlets 22 provide combustion air from air space 6 into flame space 19. Flame space 19 has a nozzle-shaped passage 23 which has an abrupt cross-sectional change 24 at the junction with passages 25 and 26. Passage 25 connects auxiliary combustion chamber 4 with flame chamber 14 and passage 26 connects auxiliary combustion chamber 4 with flame chamber 15. Control air lines 27 and 28 are provided for directing the auxiliary flame from auxiliary combustion chamber 4 alternately into flame chamber 14 or flame chamber 15. When compressed air is supplied by control air line 27, the auxiliary flame is directed through passage 26 into flame chamber 15 as indicated by arrow 29. When control air is supplied over air line 28, the auxiliary flame is directed into flame chamber 14 as indicated by arrow 30. To promote efficient and complete combustion in flame chamber 14 or 15, it is preferable that passages 25 and 26 be directed tangentially into their respective flame chambers. The control of the auxiliary flame makes use of the Coanda effect by which a jet flow adheres to a wall and can be guided along the wall. The abrupt cross-sectional enlargement 24 enhances the Coanda effect.

The abrupt enlargement of the cross-section at the junction 13 of the flame tube 2 and antechamber 1 causes a pronounced turbulence in flame chamber 14. This turbulence promotes fuel blending and permits combustion to be stabilized in flame chamber 14 even with very lean fuel-air mixtures. An even leaner flame can be stabilized in chamber 14 by use of a rich auxiliary flame directed into flame chamber 14 from auxiliary combustion chamber 4 through passage 25 as indicated by arrow 30.

The cross-sectional enlargement in flame chamber 15 following narrow passage 16 provides similar turbulence for stabilizing a flame in that chamber. Likewise, an auxiliary flame from auxiliary combustion chamber 4 can be directed through passage 26 into flame chamber 16 as indicated by arrow 29 to enable stabilization of a lean flame in chamber 16.

Only a relatively small amount of fuel, approximately 10% of total fuel at no load engine conditions, need be provided by nozzle 20 to auxiliary flame chamber 19. This quantity of fuel is independent of engine operating conditions. Directional control of the auxiliary flame outlet is achieved by providing jets of control air over air lines 27 and 28. The burning gas current emerging from auxiliary flame chamber 19 will be directed into either passage 25 or 26 depending on which air line is provided with control air. Air on line 27 directs the flame through passage 26 as indicated by arrow 29. Air on line 28 directs the flame through passage 25 as indicated by arrow 30. Switching of the control air depends on the turbine load and may be activated by the turbine compressor pressure level. The compressed air control of the auxiliary flame makes use of the Coanda effect whereby a jet flow adheres to and can be guided along a passage wall, even if the wall is inclined to the axis of the nozzle. Cross-sectional enlargement 24 following nozzle 23 enhances this effect.

The use of the controlled auxiliary flame which can be directed alternately into flame chamber 14 or 15 permits stabilization of a lean main flame in either chamber. Changing of the flame position from one chamber to the other extends the permissible operational range with a lean fuel-air mixture.

Figure 2:
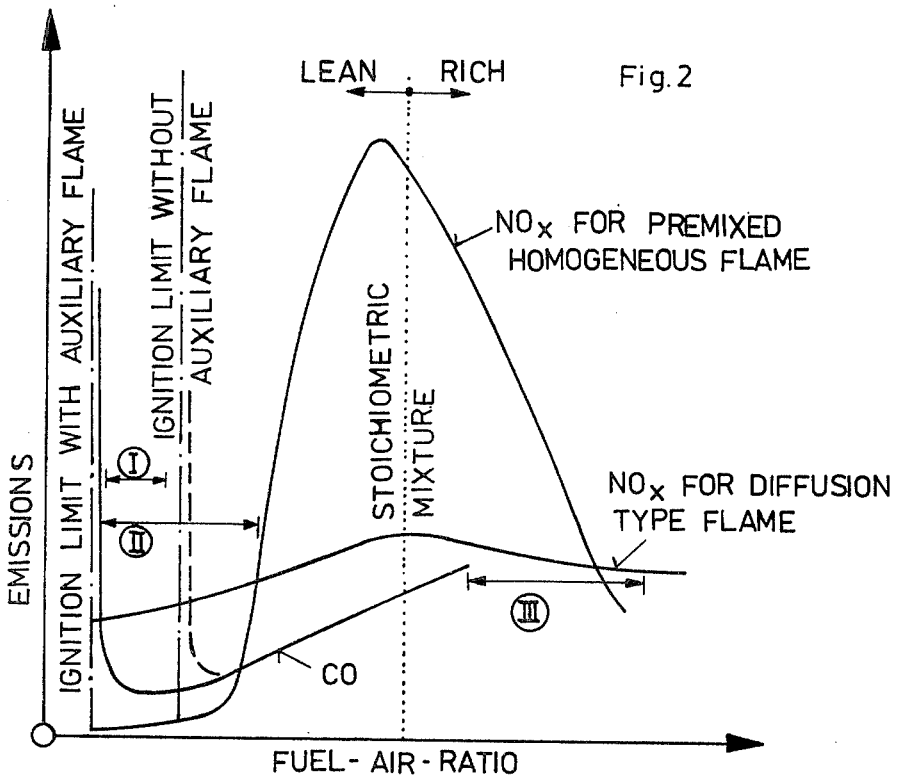
FIG. 2 is a graph showing emission levels as a function of fuel-air ratio.

A consideration of the graph of FIG. 2 is useful for explaining the principles of the invention. The graph illustrates emission levels as a function of fuel-air ratio. As is indicated, low emissions exist in the range of lean mixtures and this range is extended below the usual limit of sustained combustion by use of an auxiliary flame. Zone I illustrates the range of mixtures which can be sustained only with an auxiliary flame. Zone II illustrates the lean flame range over which combustion can take place with low emission levels. As indicated in FIG. 2, carbon monoxide emissions are relatively low for a gas turbine combustion chamber and increase only slightly as the fuel-air ratio of combustion gases is increased. For a uniform mixture of fuel and air, the nitrous oxide emissions are low for a lean mixture, Zone II of combustion gases, but rise very rapidly with fuel-air ratio and peak near a stoichiometric mixture. When the fuel is not thoroughly mixed with combustion air, a diffusion flame results and the nitrous oxide emission level varies by only a small amount with variations in the fuel-air ratio. As may be seen from the graphs of FIG. 2, nitrous oxide emissions of a lean fuel mixture are lower for a homogeneous mixture than for a diffusion flame. At higher fuel-air ratios, such as Zone III, nitrous oxide emissions are substantially lower for a diffusion flame, particularly near the stoichiometric ratio.

The emission variations plotted in FIG. 2 are used to advantage in the combustion chamber of FIG. 1, and the combustion conditions are changed in accordance with the load conditions of the turbine to achieve reduced nitrous oxide emission values. Accordingly, the combustion chamber is arranged to make use of a homogeneous mixed lean fuel-air mixture over as large a range of operating conditions as is possible, but switch to a fuel rich flame represented by Zone III at high engine load conditions. When the turbine is operating under minimum load conditions, or is decelerating, control air is supplied over air line 28 and the flame from auxiliary combustion chamber 4 is directed into flame chamber 14. Under these conditions, a relatively low quantity of fuel is injected by nozzle 8 and the auxiliary flame is required to sustain combustion in flame chamber 14. This condition is illustrated as the region labelled I in FIG. 4.

As the engine load increases from the no-load condition, and the quantity of injected fuel increases, the richer combustion taking place in flame chamber 14 would normally result in a substantial increase in nitrous oxide emissions along the graph illustrated for a uniform mixture flame in FIG. 2. Prior to the time when the injected fuel quantity is sufficient to sustain stable combustion in flame chamber 14, the air flow through control air line 28 is discontinued and air is supplied by control air line 27 directing the auxiliary flame into flame chamber 15. Because of the additional air supplied to flame chamber 15 through air inlets 17, there exists a leaner mixture which burns with lower emissions. The auxiliary flame is switched from flame chamber 14 to flame chamber 15 while the mixture of gases in flame chamber 14 is not sufficiently rich to sustain combustion in flame chamber 14. While the engine is operating under a partial load having a fuel-air ratio in the range indicated by II in FIG. 4, the flame is maintained in flame chamber 15. This range is up to approximately 60% of full engine load. Under these conditions, the nitrous oxide emissions increase according to the graph of FIG. 4, which corresponds to a section of the graph in FIG. 2 which is indicated also by II.

If the quantity of injected fuel is further increased, the mixture in flame chamber 15 would approach the stoichiometric mixture and high emissions would result. As is evident from FIG. 2, it is better for emission values to provide a rich flame, indicated by Zone III, preferably a diffusion flame, at higher engine loads. Such a rich diffusion flame can occur in prechamber 10. In order to cause the flame in chamber 15 to flash back to prechamber 10, it is necessary for the flame velocity to exceed the gas velocity. The narrowed cross-sections of the chamber, 13 and 16, provide natural obstacles to the flame flash back until the flame velocity exceeds the velocity of gas in passage 16 and 13, respectively.

Figure 3:
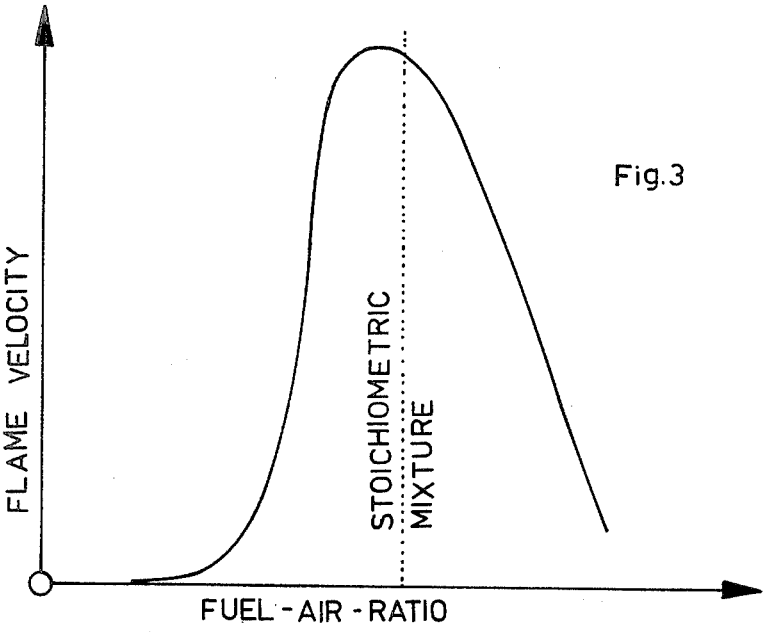
FIG. 3 is a graph showing flame propogation velocity as a function of fuel-air ratio.

FIG. 3 illustrates flame propogation velocity as a function of fuel air-ratio. As the fuel-air ratio becomes larger and approaches a stoichiometric mixture, the flame velocity undergoes a substantial increase. When the injected fuel quantity increases the flame velocity to a point at which it overcomes the velocity of combustion gases in passage 16, the flame rapidly moves into flame chamber 14 and its velocity is increased by reason of the richer fuel mixture in flame chamber 14 so that the flame enters and is sustained in diffusing region 10 of prechamber 1. This occurs near full loads or on acceleration. Since the fuel-air mixture in diffuser region 10 is not as well mixed as that in flame chambers 14 or 15, the combustion gases may burn as a rich diffusion-type flame, represented by Zone III of FIG. 2, in prechamber 10 under high engine load conditions. It should be noted that flame velocity decreases as the fuel-air ratio exceeds the stoichiometric point. Consequently, the flame is stabilized at a point in the tapered section 10 of prechamber 1 where the combustion gas velocity is equal to the flame velocity. The combustion gas mixture is richer at points in prechamber 1 which are upstream the uncontrolled air inlets 12 and 17.

As engine load decreases and the quantity of injected fuel falls below the stoichiometric mixture, the flame velocity will fall below the combustion gas velocity in prechamber 1 and eventually a point is reached where the flame will return and be stabilized in flame chamber 15. The flame blow-back is aided by air inlets 12 and 17 which further dilute the mixture with air. Thus, the flash-back and blow-back process can be controlled within close limits. Further decreases in engine load will result in a switching of the auxiliary flame so that the flame will be maintained by the auxiliary flame in flame chamber 14.

Figure 4:
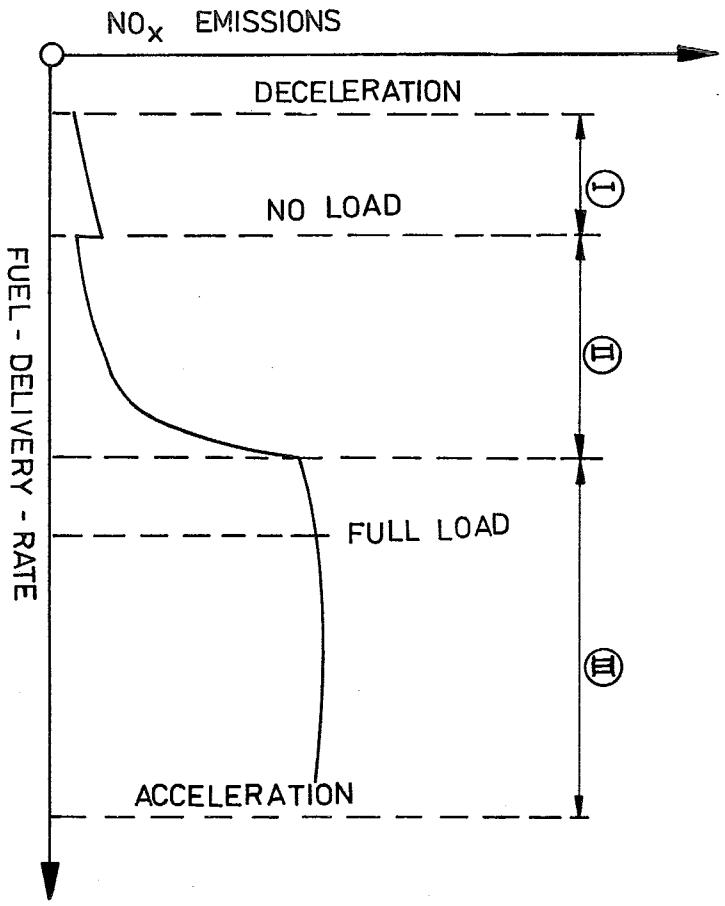
FIG. 4 is a graph showing nitrous oxide emissions as a function of fuel delivery rate for the combustion chamber of FIG. 1.

FIG. 4 illustrates the nitrous oxide emission levels during the three stages of combustion available with the combustion chamber of FIG. 1. During low load conditions having total fuel delivery rate in range I, lean combustion is provided in flame chamber 14 with assistance of the auxiliary flame. Under intermediate conditions, indicated by II, the flame is maintained in flame chamber 15 with a homogeneous lean mixture. At high engine load conditions, the flame flashes back into prechamber 1 and burns as a rich diffusion or a rich premixed flame with the nitrous oxide emission characteristic of a rich flame indicated by region III in the graph of FIG. 4.

The use of auxiliary combustion chamber 4 facilitates control over combustion chambers 14 and 15 when lean fuel-air ratios are present in the combustion chamber. Accordingly, the total range of load conditions under which a low-emission lean flame can be sustained is expanded by the switching of the flame between combustion chambers.

In accordance with the invention, the combustion in a gas turbine combustion chamber is controlled aerodynamically to minimize nitrous oxide emissions. In a preferred embodiment, three different flame positions are used with varying turbine load. The control apparatus and technique avoids use of mechanical adjustments which are difficult in the combustion chamber environment and subject to breakdown.

While there has been described what is believed to be the preferred embodiment of the invention, those skilled in the art will recognize that other and further modifications may be made thereto without departing from the true spirit of the invention, and it is intended to claim all such variations as fall within the scope of the invention.

I claim:

1. A combustion chamber for a gas turbine comprising a flame tube connected with an exhaust passage at its outlet end, and connected with a prechamber at its inlet end, said flame tube having first and second flame chambers and a narrow cross-section passage connecting said first and second flame chambers, wherein there are provided air inlet openings in the periphery of said flame tube on the downstream side of said narrow cross-sectional passage, said prechamber having a fuel delivery device and a ring-shaped air inlet opening at the end away from said flame tube, and having uncontrolled air inlet openings between said fuel delivery device and said flame tube, said prechamber having cross-sectional dimensions which are a selected amount smaller than the cross-section of said flame tube to cause a stable lean flame in said flame tube at fuel-air ratios below a selected value, and to cause flame flash-back and a stable rich flame in said prechamber at higher fuel-air ratios, associated with higher turbine loads, an auxiliary combustion chamber for producing an auxiliary flame, wherein said auxiliary combustion chamber is provided with a quantity of fuel for maintaining a rich auxiliary flame, first and second passages connecting said auxiliary combustion chamber with said first and second flame chambers, and wherein there are provided means for alternately directing said auxiliary flame through one of said passages into said first flame chamber or said second flame chamber in accordance with the load condition of said gas turbine.

2. A combustion chamber as specified in claim 1 wherein said means for alternately directing said auxiliary flame comprises first and second air lines, arranged on opposite sides of said auxiliary combustion chamber adjacent said passages and means, responsive to the load condition of said gas turbines, for providing air flow through either said first or second air line for directing said auxiliary flame through said first or second passage.

3. A combustion chamber as specified in claim 2 wherein said means for providing air flow comprises means responsive to the inlet pressure of said combustion chamber.

4. A combustion chamber as specified in claim 1 wherein said first and second passages are directed tangentially into said first and second flame chambers.

5. A combustion chamber as specified in claim 1 wherein said auxiliary combustion chamber comprises a flame space having a nozzle-shaped opening directed towards the intersection of said first and second passages, an abrupt cross-sectional enlargement of said opening in the vicinity of said passages, and control air lines arranged to direct control air toward said nozzle-shaped opening in the vicinity of said cross-sectional enlargement.

6. A combustion chamber for a gas turbine engine comprising a first flame chamber having air inlet openings and fuel delivery means, a second flame chamber connected to the outlet of said first flame chamber and having auxiliary air inlet openings, and means, responsive to turbine operating conditions, for stabilizing combustion in either said first or second flame chamber by directing an auxiliary flame selectively into either said first flame chamber or said second flame chamber.

7. A combustion chamber as specified in claim 6 wherein said flame stabilizing means directs said auxiliary flame to said first flame chamber when said turbine is operating within a selected range of low load conditions and directs said auxiliary flame to said second flame chamber when said turbine is operating under higher load conditions.

8. A combustion chamber as specified in claim 7 wherein the quantity of fuel provided to said first flame chamber by said fuel delivery means under said low load conditions is inadequate to maintain combustion in said first flame chamber without said auxiliary flame.

* * * * *